US006402405B1

(12) United States Patent
Frodl et al.

(10) Patent No.: US 6,402,405 B1
(45) Date of Patent: Jun. 11, 2002

(54) METHOD AND DEVICE FOR PAGE BY PAGE CONVEYANCE OF A PRE-PRINTED STRIPLIKE RECORDING MEDIUM IN A PRINTER

(75) Inventors: Herbert Frodl, Poing; Anton Stuerzer, Grafing; Holger Hofmann, Munich, all of (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/554,540

(22) PCT Filed: Nov. 10, 1998

(86) PCT No.: PCT/EP98/07172

§ 371 (c)(1),
(2), (4) Date: May 10, 2000

(87) PCT Pub. No.: WO99/24264

PCT Pub. Date: May 20, 1999

(30) Foreign Application Priority Data

Nov. 10, 1997 (DE) ..... 197 49 596

(51) Int. Cl.[7] ..... B41J 11/42; B41J 11/46

(52) U.S. Cl. ..... 400/582; 400/611; 400/613.1; 226/30; 226/42

(58) Field of Search ..... 101/232, 233, 101/224, 225, 228, 279, 485; 400/611, 613.1, 613.2, 617, 619, 582, 583, 583.3; 226/30, 42

(56) References Cited

U.S. PATENT DOCUMENTS

| | | | | | |
|---|---|---|---|---|---|
| 4,477,103 | A | | 10/1984 | Bertolazzi | 283/62 |
| 4,732,501 | A | | 3/1988 | Angst et al. | 400/613.3 |
| 4,839,674 | A | * | 6/1989 | Hanagata et al. | 347/104 |
| 5,366,307 | A | * | 11/1994 | McGourty et al. | 400/708 |
| 5,442,188 | A | * | 8/1995 | Brimbal et al. | 400/583.3 |
| 5,480,244 | A | * | 1/1996 | Senda | 400/582 |
| 6,056,180 | A | * | 5/2000 | Crowley et al. | 226/31 |
| 6,256,474 | B1 | * | 7/2001 | Gibisch et al. | 399/384 |

FOREIGN PATENT DOCUMENTS

| | | |
|---|---|---|
| DE | 1 937 699 | 2/1971 |
| WO | WO 95/19929 | 7/1995 |

* cited by examiner

*Primary Examiner*—Daniel J. Colilla
(74) *Attorney, Agent, or Firm*—Schiff Hardin & Waite

(57) ABSTRACT

A method and device to control a paper drive mechanism of an electrographic printer or copier by friction feed. Optical markings are provided on the recording medium, and a sensor scans an area of the recording medium for the optical marking during transport of the recording medium. An evaluation device evaluates the signals from the sensor for two successive markings corresponding to page length. High speed conveyance of the recording medium is controlled according to page length identified by the evaluation device.

21 Claims, 7 Drawing Sheets

METHOD AND DEVICE FOR PAGE BY PAGE CONVEYANCE OF A PRE-PRINTED STRIPLIKE RECORDING MEDIUM IN A PRINTER

BACKGROUND OF THE INVENTION

1. Field of the Invention

The present invention is directed to a method and to an apparatus for the transport of pre-printed, web-shaped recording media, particularly continuous form paper in an electrographic printer. Paper, foil material, labels or other materials can thereby be employed as the web-shaped recording medium.

2. Description of the Related Art

The greatest variety of paper grades are employed when printing paper. What is referred to as margin-perforated paper is mainly employed in the electrographic high-performance printer field with printing outputs of more than 40 pages per minute. This paper has lateral holes at its longitudinal edges for transport and for monitoring the position of the paper. It is thereby driven by sprocket tractors that engage into the lateral transport holes. This paper often also has transverse perforations along which the individual pages are separated from one another.

The margin perforation is particularly employed when processing pre-printed paper. Given this paper, the information subsequently applied in the electrographic printer, for example data that are printed on a pre-printed form, should come to lie as exactly as possible at predetermined locations of the pre-printed form. For positionally exact printing, the position of the paper web in the conveying direction must be exactly adjusted to or, respectively, synchronized with the drive thereof or, respectively, the movement of the photoconductor drum.

For exact positioning of such paper, the first page of the paper web is placed exactly at a specific position with respect to the sprocket tractors. A page start mark of the pre-print or, respectively, the transverse perforation thereby exactly prescribes the beginning of the page. All further pages are automatically exactly positioned due to the constrained guidance by the tractor sprocket when the first page was properly inserted.

The feed of the perforated paper usually ensues in a specific grid corresponding to the hole spacings, for example in a ½ inch grid or in a ⅙ inch grid. The paper web is then not moved continuously but step-by-step by a multiple of the grid spacing.

There is frequently also the demand in the high-performance printing field to be able to employ roll paper that does not comprise such margin perforations in printers for continuous-form paper. Both economic as well as ecological considerations contribute to this demand. When printing margin perforated paper, namely, a processing step wherein the margin strips are removed from the printed page is necessary, whereby the waste that thereby arises must be disposed of.

For example, Published International application WO 95/19929 A1 discloses a printer that is suitable for processing roll paper without margin perforations. A first seating edge, which prescribes the lateral position of the paper, as well as stabilization rollers, and an under-pressure brake and a roller arrangement with a loop-drawing means are provided in this printer for the exact transport of the paper.

Even though continuous form papers both with as well as without margin perforation can be fundamentally processed with such a device, problems arise when printing forms. When one wishes to process pre-printed paper with such a printer, then no direct allocation of the pre-printed area to the information to be subsequently printed is possible. As a result thereof, the information to be subsequently printed cannot be fitted into the pre-print positionally correct.

Causes of mispositioning are, for example, fluctuations in the paper length that derive from different ambient temperatures or different degrees of moisture of the paper web. Such fluctuations can amount to up to a few millimeters per page. Deviations in the print image on this order of magnitude are not acceptable when printing forms.

Added thereto given tractor-less friction drives is the problem that the transport precision in the feed direction cannot always be adhered to. For example, slippage between the drive drum and the paper web or manufacturing tolerances of the drive mechanism can contribute thereto.

German Patent document DE 19 37 699 A likewise discloses a friction drive for data printers. A sensor that recognizes a pre-printed mark at the edge of the form is provided given this drive. A reallocation of the line height to the printing location is undertaken with the sensor result with the respective start of the form. What is disadvantageous about this drive is that a mark adapted to the sensor must be pre-printed at a specific position of the form so that the control function can be implemented.

U.S. Pat. No. 4,732,501 A discloses a printer wherein a recording medium web is transported with a first, slower speed in an insertion mode. In this mode, the operator can align the web within the drive before the printer switches into a printing operation mode with a second, higher transport speed. The switching between these two speeds can be controlled by a sensor that detects an edge of the recording medium web at a specific position. No specific measures, however, are provided in this printer for processing pre-printed recording media.

SUMMARY OF THE INVENTION

An object of the present invention is to provide a method and an apparatus for controlling a tractorless drive for web-shaped recording media with which pre-printed recording media can be transported in a positionally exact manner.

This object is achieved by the method for controlling a tractor-less recording medium drive in, in particular, an electrographic printer that outputs information on a pre-printed, web-shaped recording medium, whereby the recording medium comprises an identical optical marking page-by-page, including the following steps: a) the leading edge of the recording medium is placed at a predetermined insertion mark of the printer in an input region; b) the recording medium is transported a prescribed length along a conveying direction with a first, relatively slow speed by a transport motor; c) a sensor senses a predetermined region of the recording medium during the transport event and sends sensing signals to an evaluation means; d) the evaluation means investigates whether the sensing signals agree with the identifier of the marking; e) the transport length lying between two successive, identical markings is identified by the evaluation means as value for a page length; and e) the printing event is initiated with a second, relatively high transport speed and the transport is controlled with the identified value for the page length. The present invention also achieves the objectives by providing an apparatus for controlling a tractor-less recording medium drive in, in particular, an electrographic printer that outputs information on a pre-printed, web-shaped recording medium, whereby the recording medium comprises an identical optical marking page-by-page, having: a) control means that drive the transport motor such that the recording medium is transported a prescribed length along a conveying direction with a first, relatively slow speed; b) a sensor that senses a predetermined region of the recording medium during the transport event and sends sensing signals to an evaluation means, whereby c) the evaluation means investigates whether the sensing signals agrees [sic] with the identifier of the marking and the transport length lying between two successive, identical markings is identified as value for a page length; and d) the printing event is initiated with a second, relatively high transport speed and the transport is controlled with the identified value for the page length. Advantageous embodiments of the invention are the improvements to the method, including that the evaluation means comprises a memory in which at least one value for a standard page length is stored; and in that the value for a page length determined with the sensor is checked with the standard value or the standard values for plausibility before the determined value is identified as value for the page length. Following the identification of the page length, the recording medium is moved at least once opposite the conveying direction such that the first mark comes to lie in the active region of the sensor and, taking the identified page into consideration, is subsequently accelerated anew to the second mark, whereby the characteristic drive values thereby employed are stored for employment after a print stop. The sensor is preferably sensitized to the markings and/or to the background of the markings before it senses the recording medium for markings. The sensor ensues in that the recording medium is transported at least once in the direction of and opposite to the conveying direction, and the evaluation means checks during this forward and return motion to see whether and when the sensor outputs a signal. In one embodiment, the sensitization of the sensor ensues spectrally. The sensitization of the sensor may ensues in view of the shape of the marking. A sensor setting value determined during the sensitization is preferably stored. The information-containing components, particularly text components of pre-printed forms may be employed as the marking. The recording medium is typically paper.

It is provided in the invention to apply the leading edge of the pre-printed web of the recording medium provided with markings to a predetermined insertion mark in an input region of the printer. Subsequently, the recording medium web is transported a predetermined length along a conveying direction by a transport motor with a first, relatively low speed. A sensor thereby senses a predetermined region of the paper and sends sensor signals to an evaluation means. This evaluates the signals and checks whether they can be allocated to a predetermined mark. The transport length lying between two successive marks is then identified by the evaluation means as a value for a page length. Finally, the printing event is initiated with a second, relatively high transport speed and controlled with the identified value for the page length.

What the invention enables is that the drive for the web of the recording medium is already synchronized to the page length after a feed of one page. Positional deviations of the web that occur due to imprecise insertion of the paper web or due to increased slippage between the drive and the web are thereby already compensated after the first printed page. As a result of the invention, it is also possible to transport recording medium webs that contain indefinite pre-prints in a positionally exact manner. For example, the pre-prints can be indefinite in terms of type, color, shape, the size (length) or the position on the recording medium. The control requires only a negligible time for transient response. Maculature, i.e. excess, unprinted paper is largely avoid as a result thereof. The printing already ensues in a positionally exact manner within the pre-print with the first printed page.

In a preferred exemplary embodiment of the invention, the evaluation means comprises a memory in which at least one value for a standard page length is stored. The value for a page length determined with the sensor is checked against the standard value or the standard values for plausibility before the identified determined a value is identified as value for the page length. As a result thereof, it is possible to synchronize the drive exactly with the page length of the pre-print even when the page length deviates from the theoretical rated value.

In another advantageous embodiment of the invention, the sensor is sensitized for the markings and/or for the background of the markings. It is also advantageous to arrange the sensor so as to be displaceable transversely relative to the recording direction. The mark can then lie at an arbitrary location of the form. Even constituent parts of the form such as texts, graphics or window cut-outs can then be employed as a mark. The sensor of the invention can thus be adapted to the respective content of the form in that it is sensitized for a selected item of information.

In particular, the sensor can be of an optoelectronic type; the sensitization in a preferred exemplary embodiment then ensues for specific colors of the background or, respectively, of the mark. Alternatively or additionally, the sensitization of the sensor can also ensue in view of a geometrical shape of the markings or in view of the surface structure of the recording medium web. For example, the marks can thereby be notches provided in paper webs or window cut-outs in form originals. A sensor setting value determined in the sensitization is preferably stored and re-employed for later measurements.

The sensitization of the sensor preferably ensues in that the paper is transported at least once in the conveying direction and once opposite the conveying direction, whereby the evaluation means checks during this forward and return motion whether and when the sensor outputs a signal. It can thereby be provided that a plurality of cycles or forward and return motions are implemented and that a setting value at the sensor is modified after every cycle. The sensor setting values that are finally determined can then be stored and re-employed for later sensitization events. A self-learning system can thereby be generated in that a certain plurality of the setting values that are employed most often and/or most recently is employed at the beginning of a sensitization procedure.

What is particularly achieved with the inventive starting procedure is that the printing event can begin with the first page that follows the page required for the sensitization of the sensor.

The inventive procedure can be largely automated. Operating errors upon insertion of the paper are thereby largely precluded or, respectively, can be compensated. The procedure requires only little time, as a result whereof the effective printing time of the printer is high.

BRIEF DESCRIPTION OF THE DRAWINGS

Exemplary embodiments of the invention are explained in greater detail below on the basis of some Figures.

DETAILED DESCRIPTION OF THE PREFERRED EMBODIMENTS

Figure 1:
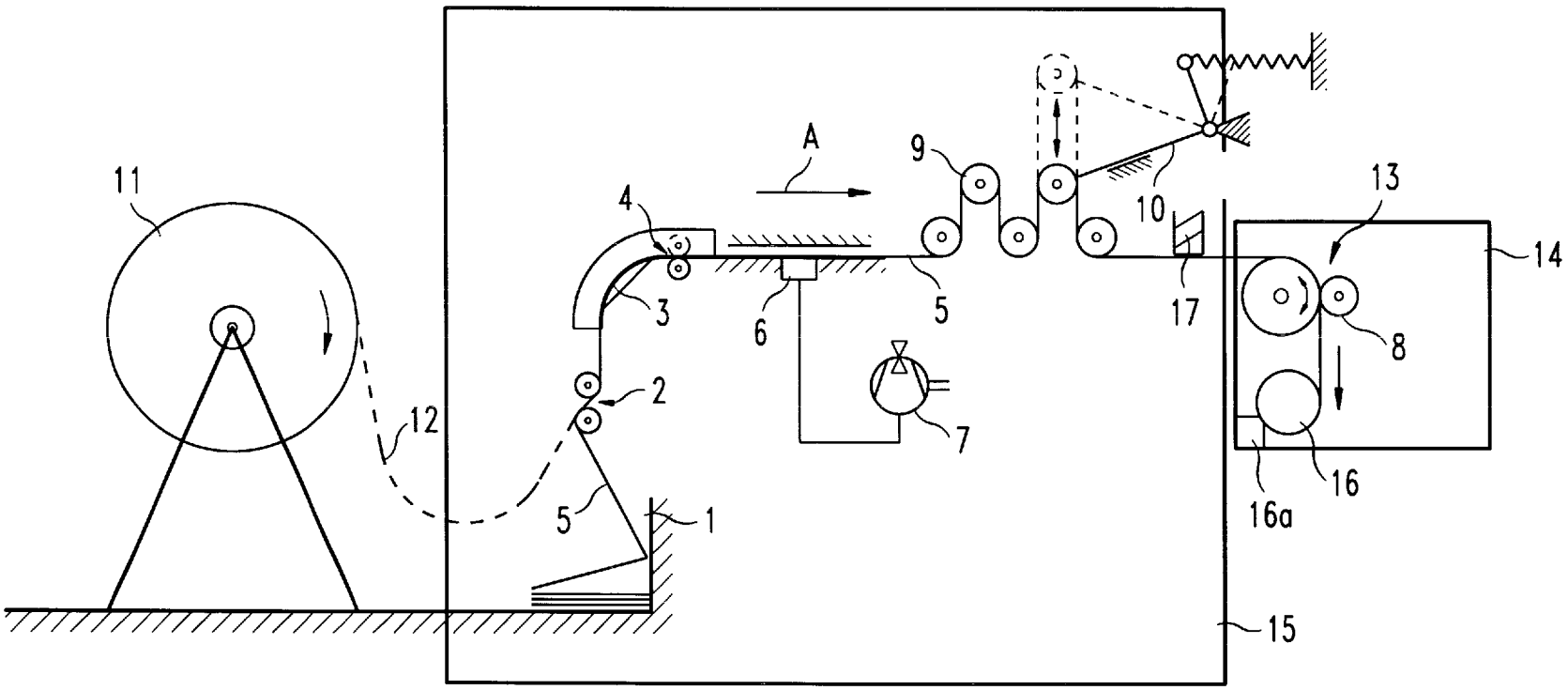
FIG. 1 is a schematic side view in section of a printer with a tractorless paper drive.

The printer device shown in FIG. 1 takes a web-shaped recording medium 5 of paper from a paper input container 1 or from a supply reel 11. In the roll operation, the paper web 5 is supplied via a loop 12 to a deflection means 2 and is subsequently guided in a web pre-centering means 3 along a seating edge to friction drive rollers 4. Subsequently, it is pulled by a drive 8 via an under-pressure brake 6 that is connected to a vacuum pump 7 that generates the under-pressure. The paper web 5 is decelerated due to the under-pressure, and the tension of the paper web 5 is thereby increased. The paper web 5 runs all the more stable in a conveying direction A, the higher the tension is, i.e. it slides laterally out of the rated paper conveying direction to a lesser extent. Following the under-pressure brake 6, the paper web 5 passes through a stabilization zone that is composed of a plurality of deflection rollers 9 and a loop-drawing means 10. The paper web 5 wraps the deflection rollers 9 by at least 180°, as a result whereof the paper web is laterally stabilized even further.

Before the paper web 5 is supplied to a printing unit 14, a sensor arrangement 17 optically senses the paper 5. The sensor arrangement 17 is thereby designed such that it can still sense the widest paper 5 to be processed in the printer over its full width. The width of the sensor arrangement 17 is thus matched both to the mechanical components for the paper transport as well as to the parameters of the printer means 14 that define the printable width. In the present exemplary embodiment, the paper width that can be processed extends from 6.5 inches (165 mm) to 19 inches (482.6 mm). Details of the sensor arrangement 17 are disclosed in German Patent Application Serial Number DE 197 49 676.8 filed by the assignee, the content thereof being herewith incorporated into the present specification by reference.

The paper web 5 is supplied from the sensor arrangement 17 to a transfer printing station via a drive unit 13. In the illustrated exemplary embodiment, the transfer printing station comprises a photoconductor drum 16 that interacts with a corotron means 16*a*. In a known way, the photoconductor drum 16 is thereby charged with information corresponding to an image by means of light, as a result whereof a charge image is applied. Subsequently, it picks up a magnetized or charged toner that is transferred onto the paper web 5 in the transfer printing area. Subsequently, the corotron means 16 in turn discharges the corresponding region of the photoconductor drum 16, so that this can be written anew with information. The corotron means 16*a* thereby functions in a way known per se such as disclosed, for example, European Patent document by EP 0 224 820 B1.

In the illustrated example, the sensor arrangement 17 is arranged in the region of the paper feeder means 15; however, it can also be provided inside the printing unit 14. The paper web 5 is transported in the paper conveying direction A.

Figure 2:
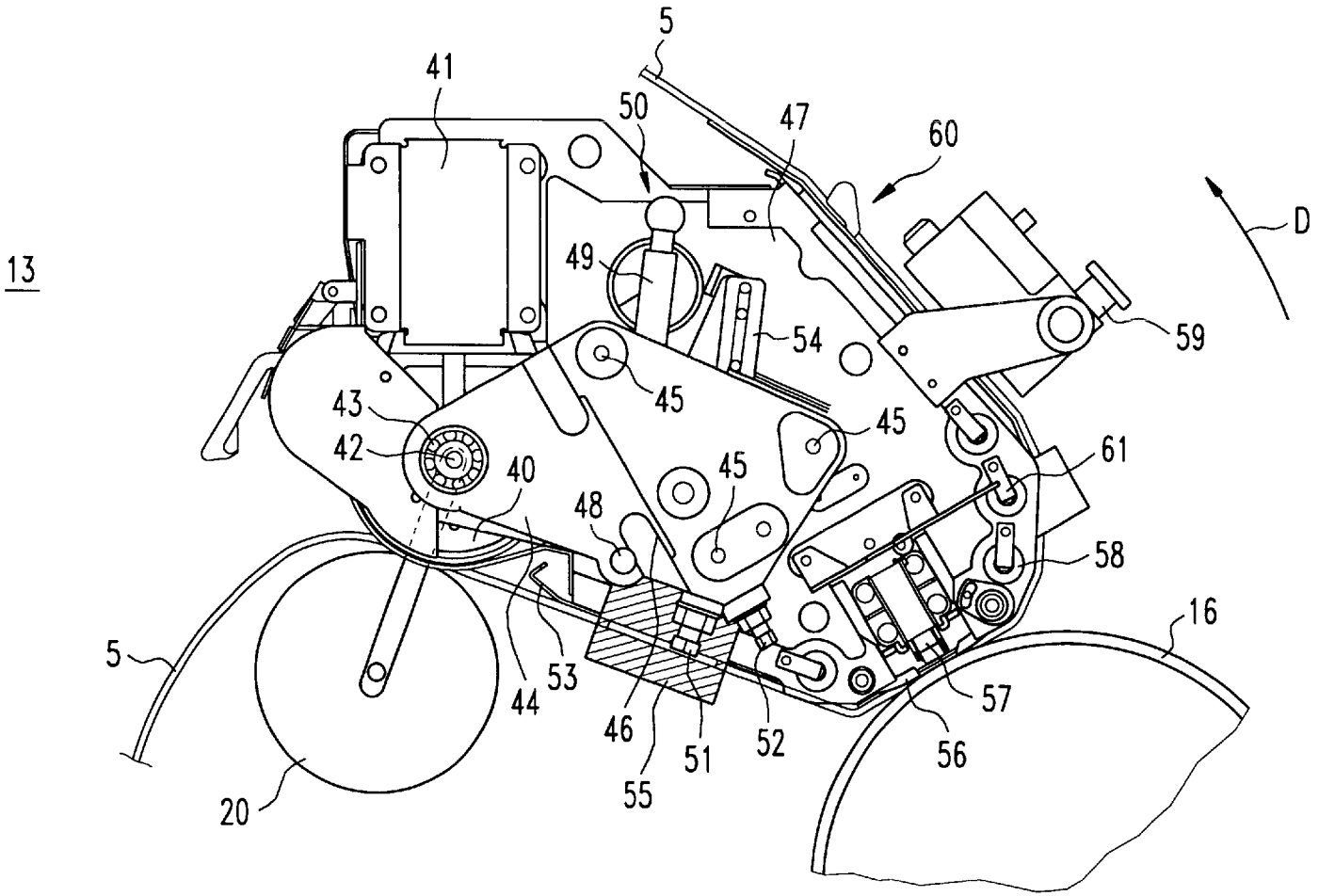
FIG. 2 is a side section through a drive unit.

FIG. 2 shows the drive unit 13 arranged in the region of the transfer printing station or, respectively, of the photoconductor drum 16 of the electrophotographic printer in greater detail.

A roller arrangement 20 presses against the drive drum 40 with a predetermined force. As a result thereof, the paper 5 which is transported between the drums 40 and 20 is moved by the drive drum 40 as a result of frictional engagement (friction). The drive drum 40 is in turn connected to the stepping motor 41 via a toothed belt drive. The entire drive unit 13 is flanged to a printer housing via the bearing block 44. A common bearing axis 42 is seated at the bearing block 44 by the ball bearing 43, the common bearing axis accepting, on the one hand, the rotational motion of the drive drum 40 and, on the other hand, enabling a swivel motion of the drive elements around the swivelling axis B. In order to enable the swivel motion, the drive components are mounted on a carrier plate 47 that is connected to the bearing block 44 via a gas compression spring 49 as well as via the bearing axis 42.

Threads 45 located in the bearing block 44 serve for the acceptance of fastening screws that are guided through the printer housing. The entire drive unit is adjustable within the printer housing via guide surfaces 46. The carrier plate 47 is in turn adjustable relative to the bearing block 44, whereby a first adjustment screw 51 and a second adjustment screw 52 against which cylinder pins at the carrier side strike are provided in the bearing block 44.

The gas compression spring 49 is connected to the carrier 47 by the screw connection 50 and is connected to the bearing block 44 by the screw connection 48. The carrier 47 and the bearing block 44 can be locked relative to one another with the locking means 54.

A paper web 5 that is introduced into the drive unit 13 between the drive drum 40 and the counter-pressure drum 20 is guided to a paper sensor 55 by a guide plate 53. The paper sensor 55 senses the paper 5 over the entire width of the printable region of the photoconductor drum 16, as a result whereof both the lateral paper edges as well as potential margin perforations of the paper web 5 can be recognized. In the region of the transfer printing zone of the printer unit, the paper is pressed against the surface of the photoconductor drum 16 by spring-seated swivel jaws 56. A known corotron means 57 generates a high-voltage with which the toner located on the photoconductor drum 16 is drawn to the paper. Deflection rollers 58 move the paper 5 forward to a mark sensor 59 that recognizes any printing or cutting marks that may be present on the paper web 5. Grounded electrical connections 61 (anti-static plates) carry off any residual electrical charges located on the paper 5.

When margin perforated paper 5 is transported with the paper transport, the margin perforation can be sensed with a pin feed wheel 60.

Figure 3:
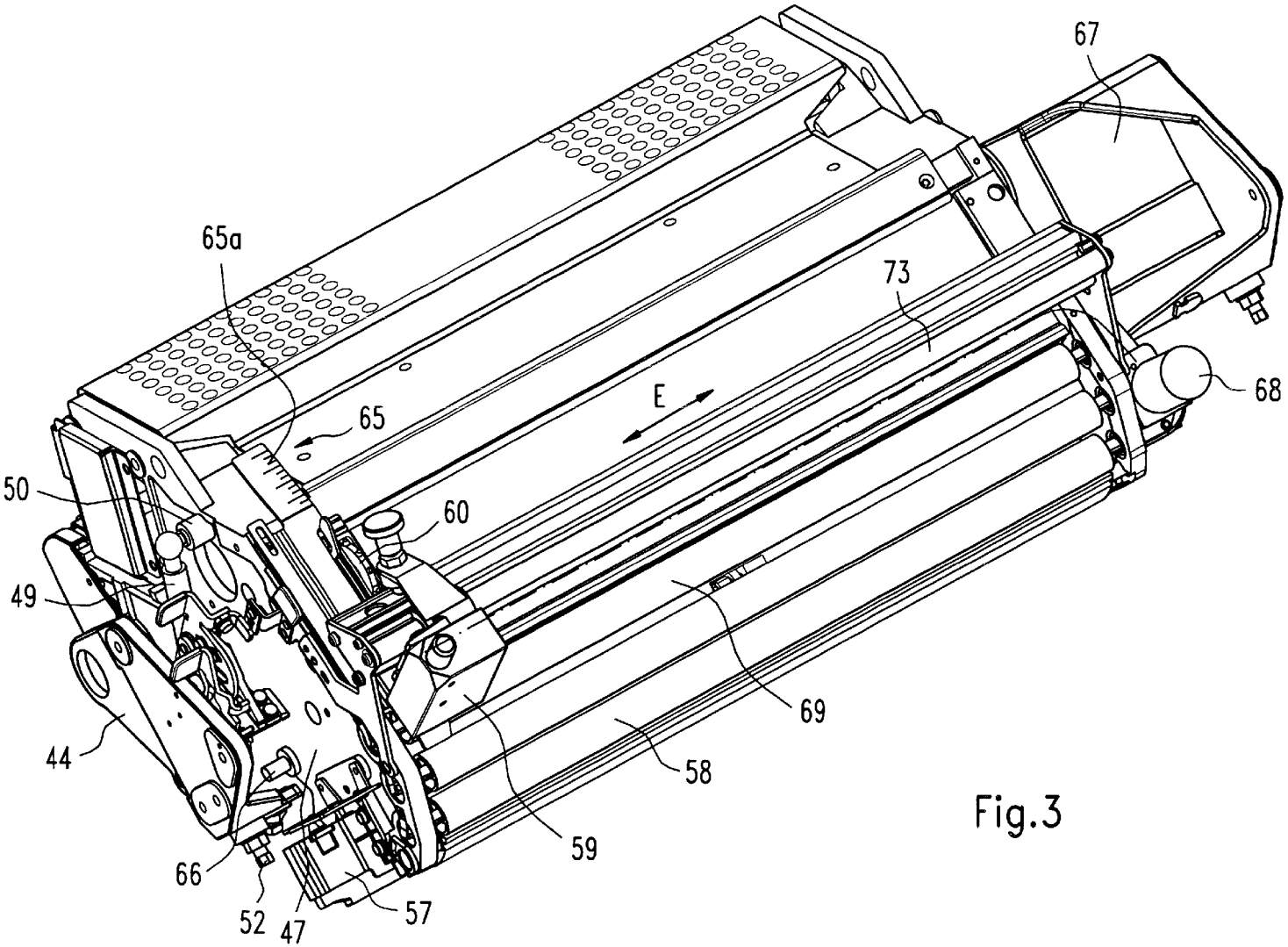
FIG. 3 is a front perspective view of the drive unit.

FIG. 3 shows a perspective illustration of the paper drive 13. In particular, the cylinder pin 66 which is mounted at the carrier plate 47 that interacts with the adjustment screw 52 screwed in the bearing block 44 as well as the screw connection of the gas compression spring 49 can be seen therefrom.

The paper 5 is guided by a guide surface 69 above the deflection drums 58. The sensing of the paper 5 with the mark sensor 59 also ensues in this region. Further, a seating rule 65 is provided in this region, this being employed for the printer start. Newly inserted paper 5 that comprises margin perforations thereby has a page start placed against a marking 65*a* of the rule 65 that corresponds to the page length, the margin perforation is brought into engagement with the engaged pin wire 60, and the printing operation is initiated. The pin feed wheel 60 is a component part of a sensor arrangement that is described in greater detail in FIG. 4.

In the transfer printing area, a drive motor 68 pulls a corotron wire from the corotron wire cassette 57 according to the page width to be printed. The mark sensor 59 is displaceable in the direction E along a rod 73. A plate covers the drive motor 41 and serves, in particular, as electromagnetic shielding. Corresponding to the front bearing block, a back bearing block 67 is also provided, this being likewise secured to the printer housing.

Figure 4:
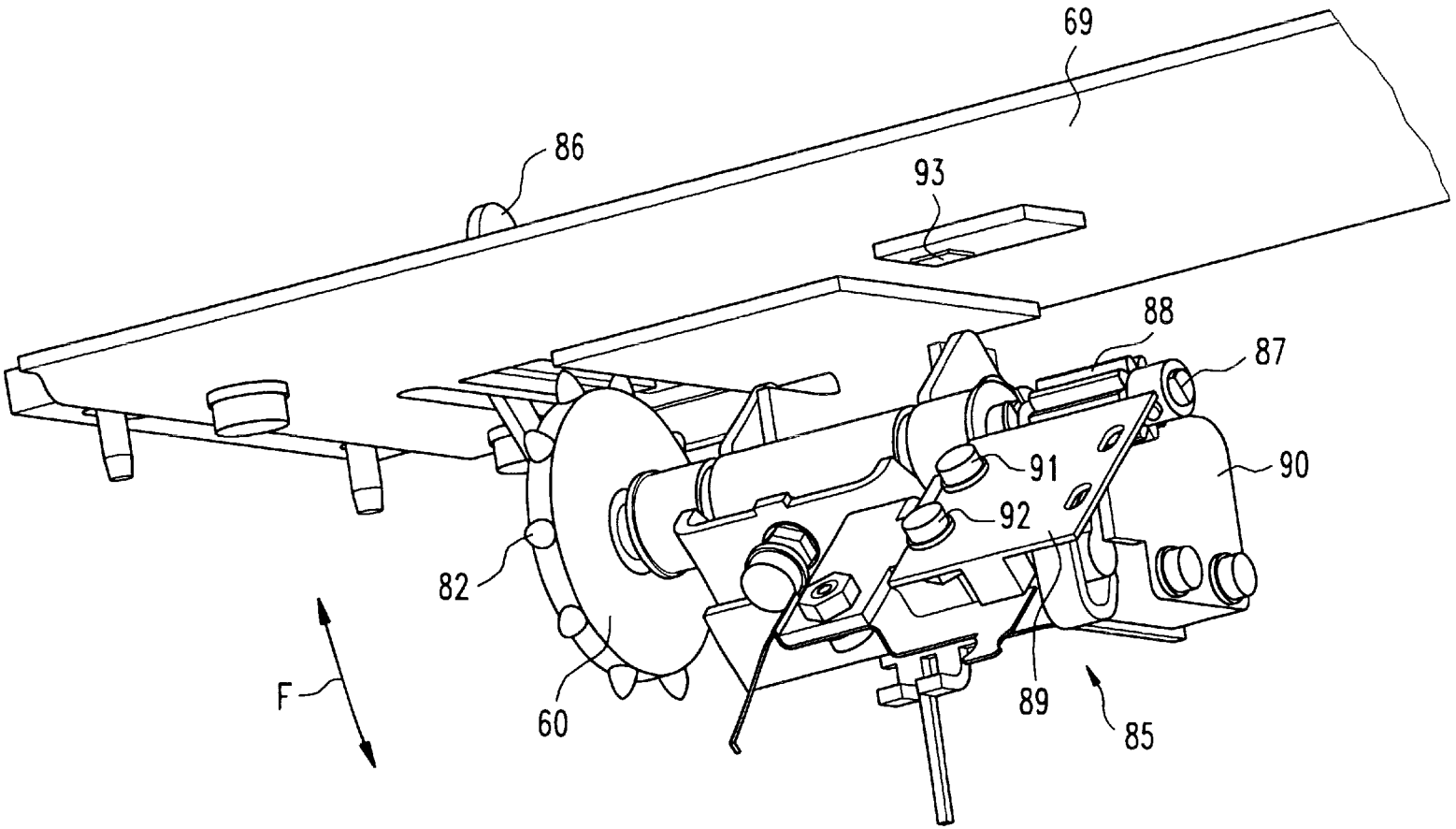
FIG. 4 is a bottom perspective view of sensor arrangement.

FIG. 4 shows the pin feed wheel sensor 85 that embraces the pin feed wheel 60. In the illustrated position, the pin feed wheel 60 is pivoted out, i.e. the pins do not project beyond the paper-guidance plane 69. The pin feed wheel 60 can be pivoted in or, respectively, out in the direction F with the actuation lever 86. The pin feed wheel 60 is seated on a shaft 87 that likewise carries a gearwheel 88. A magneto-resistive sensor 91 detects pulses of the metal cogs of the gearwheel 88.

These pulses can be unambiguously allocated to the rotational motion of the pin feed wheel 60, so that a sensing of the margin perforation of paper can thus ensue, the paper running over the paper plane 69 and being in engagement with the pin feed wheel 60. Consequently, the speed of the paper web 5 as well as its position with reference to the transport grid of the drive mechanism can be determined from these pulses. The signals of the sensor 85 are therefore employed as input signals for an anti-slip control of the paper drive. The sensor assembly 89 is electrically connected to a device controller (FIG. 5) for this purpose.

A second magneto-resistive sensor 92 detects whether the pin feed wheel sensor 85 is in the swivelled-in or swivelled-out position with respect to the paper guidance plane 69. To this end, it interacts with a magnet 93 that is mounted on the guide surface 69. The entire pin feed wheel sensor 85 can be latched in the swivelled-out or, respectively, swivelled-in position with a latch mechanism 90.

Figure 5:
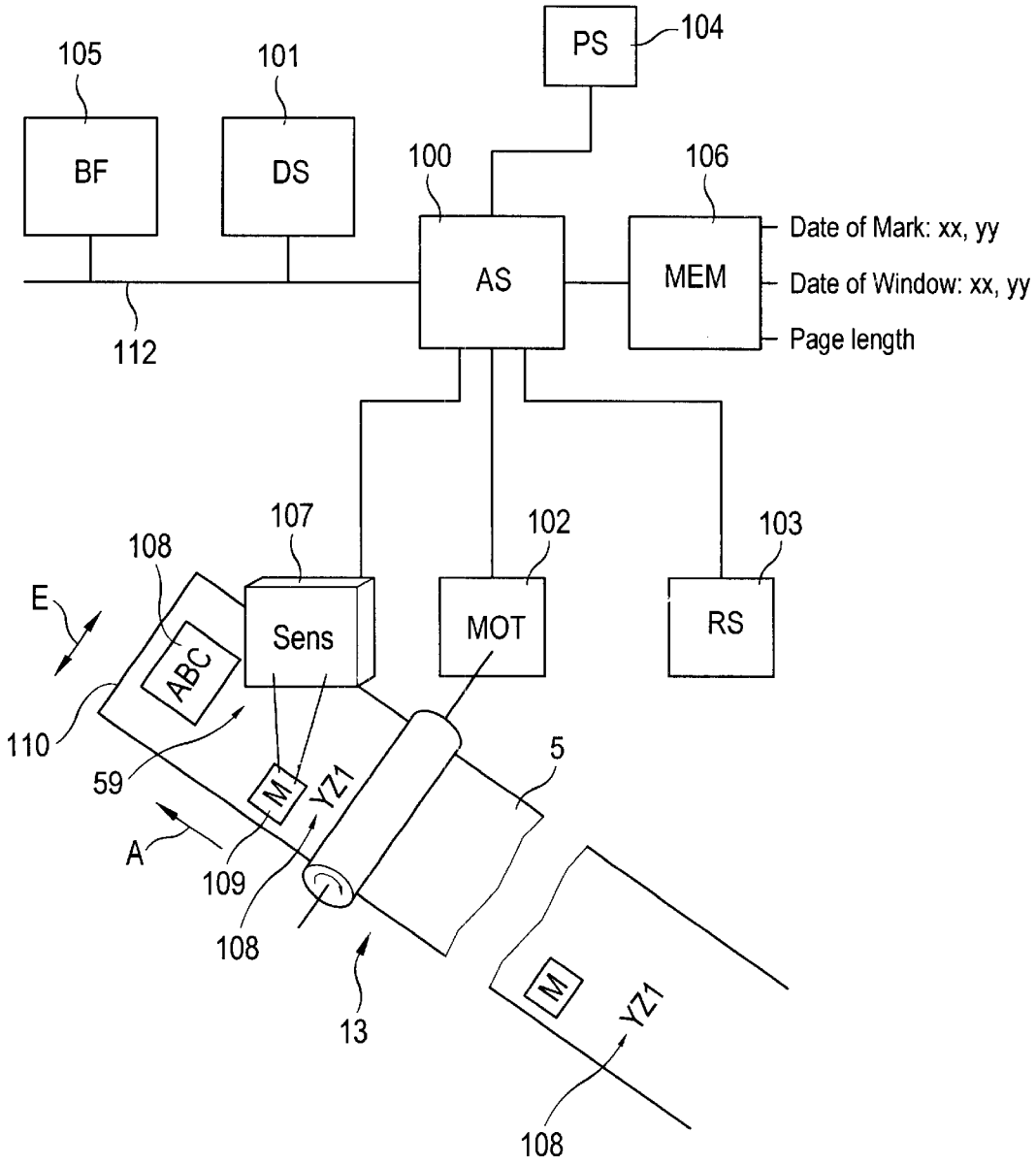
FIG. 5 is a block circuit diagram for the control of the drive with a schematic representation of the recording medium.

FIG. 5 shows electronic control components of the printer as well as their collaboration with the drive mechanism and sensors. The drive unit 13 has a drive controller 100 that is connected via a general data bus 112 to a higher-ranking printer controller 101. The operator can input commands via a control panel 105. The drive controller 100 receives the signals of the paper width sensor 17 or, respectively, 55 via the interface 104 thereof. It determines both the paper width as well as the type of paper, i.e. whether margin perforations are present, therefrom. The drive controller 100 also receives the sensor signals of the pin feed wheel sensor 85 via its electronics 103 as well as those of the mark sensor 59 via its electronics 107. The speed of the paper web 5 is calculated in the drive controller 100 from the signals of the components 103 or, respectively, 107. The result is employed for anti-slip control of the stepping motor drive 102. The rated speed signals are thereby supplied by the printer controller 101.

One proceeds as follows for preparing for a printing event (start operating mode) after the printer is turned on or after insertion of a new paper web 5:

A paper web 5 is manually drawn into the printer up to the drive unit 13 by the various components of the unit. Thereat, the leading edge 110 of the paper web 5 thread up to the guide surface 69 in the region of the rule 65.

When the paper web 5 comprises a margin perforation, this is brought into engagement with the pins 82 of the swivelled-in pin feed wheel 60. When the paper web does not comprise margin perforation, the pin feed wheel 60 is placed into the swivelled-out condition.

The feed of the paper web 5 already ensues via the drive motor 41 in the region of the rule 65. The operator thereby determines the direction of the feed (forward/backward) in order to exactly align the start of a page with a marking of the rule 65 corresponding to the page length. The feed thereby ensues relatively slowly and in small grid steps.

Given margin perforated paper 5, the transport steps in the start operating mode amount to only fractions of the hole grid spacing, which typically amounts to 1/6 inch (approximately 4.3 millimeters). The step width amounts, for example, to 1/20 grid spacings (approximately 0.21 millimeter). Given this type of transport, the speed or the position of the paper 5 is acquired with the pin feed wheel sensor 85 and 15 is compared to the speed or position of the drive motor 41. Any slip, i.e. a discrepancy between these two speeds or positions, which occurs is thereby identified and compensated by additional advance (additional steps in conveying direction) by the drive controller 100.

When paper 5 without a margin perforation is employed, the position and/or speed of the paper web 5 are sensed with the mark sensor 59 whose electronic components 107 deliver corresponding signals to the drive controller 100. Instead of the above-described sensor 59, other, known sensors can be employed for measuring speeds, for example the sensor disclosed by German Patent document DE 44 28 156 A1 or the sensor disclosed by U.S. Pat. No. 5,204,620.

Figure 6:
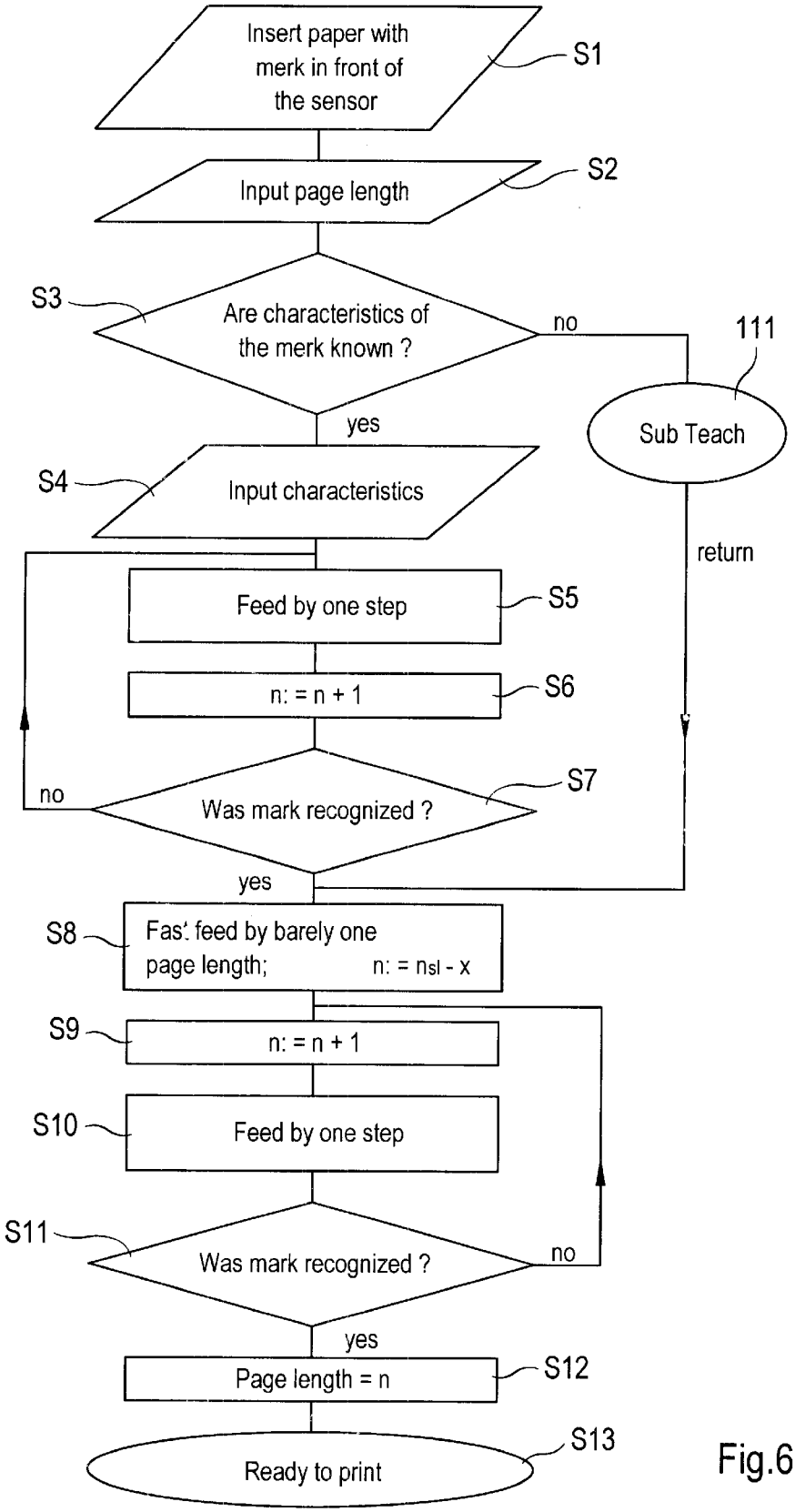
FIG. 6 is a flowchart for controlling the drive.
Figure 7:
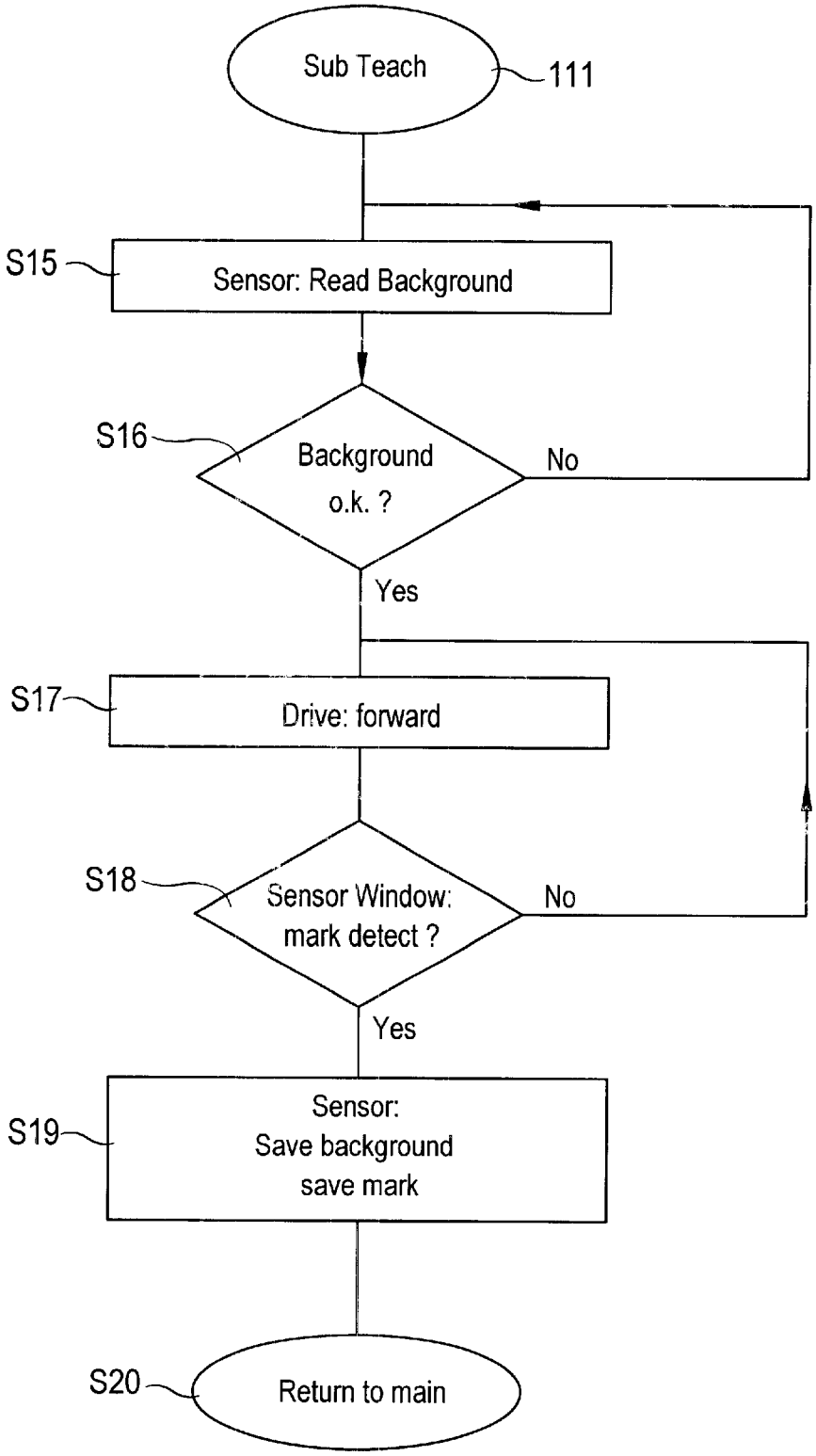
FIG. 7 is a flowchart for sensitizing the sensor.

The procedure for the correct insertion and conveying of the paper 5 as well as for sensitizing the mark sensor 59 is described below with reference to FIGS. 5, 6 and 7.

First, the paper web 5 is roughly positioned with its leading edge 110 in the region of the sensor 59 or, respectively, of the rule 65. The operator is thereby granted a certain tolerance of, for example, a few millimeters by which the position of the leading edge (page start) is allowed to deviate from the rated position. A corresponding insertion marking 65*a* is provided on the rule 65 for the rated position. Various insertion regulations are possible for this purpose. For example, the insertion marking 65*a* can lie at various locations of the rule 65 dependent on the page length. Alternatively, a common insertion marking 65*a* can also be provided on the rule 65 for various page lengths. Finally, the insertion marking 65*a* can also lie directly under the sensor 59, i.e. at its sensing point. (Step S1). The page length on which the pre-print is based is then input at the control panel 105 of the printer and the value is stored in the memory 106 (step S2).

A specific information that is intended to serve as a mark 109 is then selected from the forms that are pre-printed on the paper web 5. This mark 109 can be both a text as well as graphic information, whereby it is also conceivable to employ a modified surface structure, for example a window cut-out punched into forms. The sensor 59 is matched to the respectively selected mark information. In the present exemplary embodiment, an opto-electronic sensor 59 is employed that has a high contrast sensitivity as well as a color sensitivity. If the window cut-outs were to be employed as the mark information, then, for example, a mechanical sensing device or an ultrasound sensor could also be suitable as the mark sensor 59. An information 108 of the form that occurs only once per form page with reference to the feed direction A should be employed as the mark 109. When it occurs more often, then the evaluation electronics 107 of the sensor 59 or, respectively, the unit controller 100 must be in the position to filter out the repetitions within the page, so that the drive can be respectively exactly regulated to the page start information.

When characteristic properties of the mark 109 such as the magnitude of the contrast transition, color of the background, color of the mark information, etc., are known, these can likewise be input via the control panel 105 and stored in the memory 106 (steps S3, S4).

The information about the region of the form in which the mark 109 lies is also queried and potentially stored. As a result thereof, a window is prescribed within the form wherein the sensor 59 reacts to the mark information.

By prescribing a mark window, it is also assured that the mark information is allocated to the correct page, even when one and the same mark 109 repeatedly occurs identically on a form page. The data transfer between control panel 105, higher-ranking printer controller 101 and unit controller 100 ensues via the data bus 112.

The characteristic data about the mark 109 can also be offered by the printer controller 101 insofar as it obtains these data in some other way. For example, the data can be co-supplied in the header area of a print job. An operator who compiles this print job on a higher-ranking control computer (print server) can attach these particulars to the print job at this stage, as a result whereof the printing event is automated further upon arrival of the print job.

When the characteristic values of the mark 109 are not known, an automatic procedure 111 is started with which the unit controller 100 fully automatically acquires and stores the characteristic values of the mark 109. What is referred to as this sensitization procedure is described in greater detail later in conjunction with FIG. 7.

Returning to FIG. 6, a step-by-step advance of the drive 13 in an extremely small grid ensues that corresponds to only 1/20 of the hole grid spacing of margin perforated paper 5. In this phase, the actual page length of a form is identified on the paper web 5. A counter n is incremented by the value 1 with every feed step (S5) and a check is subsequently carried out to see whether the mark 109 was recognized (step S7). If not, another forward step is undertaken and the counter n is again incremented (steps S5, S6). When the mark has been recognized, the page length value is taken from the memory 106 and an advance by barely one page length is undertaken, i.e. by a number of steps that is smaller by x than the number of steps of the page length ($n_{s1}$, step S8).

Subsequently, another step forward is respectively undertaken and the step counter n is incremented by the value 1 (steps S9, S10). Subsequently, another check is carried out to see whether the next, following mark 109 was recognized (step S11); if not, another advance and incrementation are undertaken; if yes, then the value n is retained as a current page length value and is stored in the memory 106 (step S12). Subsequently, a "ready to print" message is generated (step S13). Before the printing event can be started on the photoconductor drum 16, the paper 5—using the previously identified values for the page length and for the mark position—is also positioned attitudinally correct relative to the photoconductor drum 16.

With the described method, both the exact position of the pre-print on the paper 5 relative to the print element as well as the actual form length which is important for the paper transport can be determined. The printing event can be started immediately with high registration precision with the exact information about the position of the forms and the length of the forms.

For sensitizing the sensor 59 (FIG. 7), the sensor 59 is first adjusted onto the background of the paper web 5 in the procedure 111. To that end, the unprinted paper web 5 is sensed by the sensor 59 and the sensor signals are read and intermediately stored (step S15). Subsequently, a check is carried out to see whether the background information exhibits an adequately high signal strength (step S16). When not high enough, sensor parameters such as gain, illumination intensity or the like are modified and the step S15 is repeated until the sensor signals are adequately high. Subsequently, the paper web 5 is moved forward (step S17) in the recording direction until the sensor 59 detects an adequately big marking to be distinguished from the background (step S18). When, given a predetermined plurality of feed steps, no mark 109 can be identified with adequate precision, then the paper web 5 is again completely retracted, the settings at the sensor 59 are modified and a renewed search run is started. The sensor settings are thereby modified until the sensor 59 recognizes a mark 109. The operator can abort the search procedure at any time. In addition to the brightness of the light sources integrated in the sensor 59, the spectral distribution (red, green, blue) thereof can also be modified. As a result thereof, colored markings can be reliably recognized by the sensor 59 in front of a colored background. The identified values for the background and the mark 109 are stored in the memory 106 (step S19). Following the step S19, the start procedure is continued with the step S8. An instruction command, "return to main", is output for this purpose (step S20).

During the normal operating mode, wherein the printing process is running, the paper web 5 is processed page-exactly, whereby complete pages are always printed. Slip-page between the drive 13 and the paper web 5 in this operating mode is acquired in a way similar to that in the start operating mode, but is not compensated not on the basis of additional feed but by a higher speed of the drive motor 41. When paper having margin perforation is employed, the margin holes are continuously sensed by the pin feed wheel sensor 85 and the sensor signals are employed for anti-slip control. When paper 5 without margin perforation is employed, then the marking 109 is sensed page-by-page and this sensing result is employed for anti-slip control. This page-by-page sensing can also be employed instead of or in addition to the sensing of the pin feed wheel sensor 85 given margin perforated paper 5. What is of concern given this page-by-page control version, however, is that the drive 13 is so exact that no great dislocations of the print image are present within a page at the page end (or, respectively, shortly before the mark 109 of the next page).

When a printer stop is necessary proceeding from the ongoing printing mode, then the drive controller 100 does not effect an immediate stop of the drive but a stop at the next page change. As a result of this measure, the allocation of the steps of the drive motor 41 to the sensed marks 109 is very well maintained.

Given re-assumption of the printing event following a print stop, the drive is initially moved a few steps or even page lengths opposite the print transport the direction A and is then accelerated in direction A. The acceleration event can thereby ensue corresponding exactly to the motion of the start operating mode. Characteristic values about the necessary feed compensation can therefore likewise be stored in the start phase and can be employed in the re-assumption of an aborted printing event.

What is achieved by these measures is that the printing mode can be continued with page precision after a print stop and maculature is avoided. Since the page length of the paper web 5 is known from the start operating mode, its value can be re-employed following a print stop. The procedure for determining the page length (FIG. 6) can then be foregone.

When it is necessary to re-insert the paper web 5 following a print stop, for example following a tearing of the paper, then one proceeds as follows: first, the operator positions the new paper web roughly at the rule 65 in the insertion area. Subsequently, the paper web 5 is transported forward by the drive unit 13 with a first, slow speed until the mark sensor 59 detects a mark 109. On the basis of this identified mark position and the page length determined before the print stop, the paper web 5 is again positioned page-correctly relative to the printing station 14 and the printing process is continued.

In another, improved embodiment of the start operating mode, the paper web 5 is transported back and forth between the detected marks 109 once or repeatedly relative to the mark sensor 59 following the identification of two successive marks 109. As a result thereof, dynamic conditions in the acceleration of the paper web 5 can be determined more exactly, and the drive control in the acceleration phase is improved further. In particular, a optimum speed curve of the drive, with which the slippage is largely compensated, is thereby identified. These values can be stored job-specifically or, respectively, paper-specifically and employed for an additional speed control of the drive given re-assumption following a print stop.

Using the signals of the paper width sensor 17, the drive controller 100 can also determine whether and which type of paper is introduced into the printer. To that end, the drive motor 41 is repeatedly moved forward and back and the sensor signals are interpreted. When one or more holes are recognized, then a perforated paper web 5 is assumed. An automatic alignment onto the hole grid can then also ensue automatically on the basis of the recognized hole positions.

Even though the invention was mainly described with exemplary embodiments that employ paper as the recording medium, it is self-evident that it can also be applied in conjunction with other recording media such as, for example, foils. It is also not bound to specific imaging means such a photoconductor drums but can also be employed in combination with band-shaped transfer means such a photoconductor bands or magnetographic devices.

By providing a plurality of control marks on a form page, the control precision within a page could also be enhanced given paper that is free of margin perforations. Using a motor drive that acts on the mark sensor 59 transversely relative to the paper conveying direction (direction E in FIG. 5) in the start operating phase, what can also be achieved is that the sensor 59 also automatically detects the mark in this direction. The degree of automation and, thus, the operating dependability could thereby be further enhanced.

A further automation can also be achieved when the mark sensor 59 is motor-displaced along the axis 73 in direction E for being sensitized (see FIG. 3).

Even though electrophotographic printers have been described in the exemplary embodiments, the invention can also be applied to printers with different recording principles, for example to ink jet printer or thermal transfer printers.

Although other modifications and changes may be suggested by those skilled in the art, it is the intention of the inventors to embody within the patent warranted hereon all changes and modifications as reasonably and properly come within the scope of their contribution to the art.

We claim:

1. A method for controlling a tractor-less recording medium drive in an electrographic printer that outputs information on a recording medium that is web-shaped, the recording medium having an identical optical marking on pages, comprising the following steps:

a) placing a leading edge of the recording medium at a predetermined insertion mark of the electrographic printer in an input region;

b) transporting the recording medium a prescribed length along a conveying direction with a first relatively slow speed by a transport motor;

c) sensing a predetermined region of the recording medium during the transporting step and sending sensing signals to an evaluator;

d) investigating whether the sensing signals agree ] with an identifier of the marking;

e) identifying a transport length lying between two successive identical markings by the evaluator as a value for a page length; and f) initiating a printing event with a second relatively high transport speed and controlling transport with the identified value for the page length.

2. A method according to claim 1, wherein said investigating step includes:

storing at least one value for a standard page length in a memory; and checking the value for a page length determined with the sensor against at least one standard value for plausibility before the determined value is identified as a value for the page length.

3. A method according to claim 1, further comprising the steps of:

following said identifying step for identification of the page length, moving the recording medium at least once opposite the conveying direction such that the first mark comes to lie in an active region of the sensor;

taking the identified page length into consideration, subsequently accelerating to the second mark; and storing characteristic drive values for employment after a print stop.

4. A method according to claim 1, further comprising the step of:

sensitizing the sensor so that it is capable of sensing at least one of the markings and a background of the markings before said sensor senses the recording medium for markings.

5. A method according to claim 4, wherein said sensitizing step includes:

transporting the recording medium at least once in the conveying direction and opposite the conveying direction; and checking the evaluation means during this forward and return motion to see whether and when the sensor outputs a signal.

6. A method according to claim 4, wherein said step of sensitizing the sensor provides that said sensor is spectrally sensitive to said markings or said background.

7. A method according to claim 4, wherein said step of sensitizing the sensor provides that said sensor is sensitive to a shape of the marking.

8. A method according to claim 4, further comprising the step of:

storing a sensor setting value determined during said step of sensitizing.

9. A method according to claim 1, further comprising the step of:

utilizing information-containing components of preprinted forms as the marking.

10. A method according to claim 1, wherein paper is employed as said recording medium.

11. An apparatus for controlling a tractor-less recording medium drive in an electrographic printer that outputs information on a recording medium that is web shaped, the recording medium having an identical optical marking on pages, comprising:

a transport motor;

a controller that drives the transport motor such that the recording medium is transported a prescribed length along a conveying direction with a first relatively slow speed;

an evaluator;

a sensor that senses a predetermined region of the recording medium during transport and sends sensing signals to said evaluator;

said evaluator being operable to investigate whether the sensing signals agree with an identification of the marking and identify a transport length lying between two successive identical markings as a value for a page length; and said controller initiating printing with a second relatively high transport speed and controlling transport with the identified value for the page length.

12. An apparatus according to claim 11, wherein said evaluator includes a memory in which at least one value for a standard page length is stored; and said controller being operable to check that the value for a page length determined with the sensor is the standard value or the standard values for plausibility before the determined value is identified as a value for the page length.

13. An apparatus according to claim 11, wherein said controller is operable such that, following the identification of the page length, the recording medium is moved at least once opposite the conveying direction such that the first mark comes to lie in the active region of the sensor and, taking the identified page into consideration, is subsequently accelerated anew to the second mark, characteristic drive values thereby employed being stored for employment after a print stop.

14. An apparatus according to claim 11, said sensor being sensitized to at least one of the markings and the background of the markings before sensing the recording medium for markings.

15. An apparatus according to claim 14, wherein the sensitization of the sensor ensues with the controller such that the recording medium is transported at least once in the conveying direction and opposite the conveying direction; and the evaluator checks during this forward and return motion to see whether and when the sensor outputs a signal.

16. An apparatus according to claim 14, wherein the sensor is spectrally sensitized.

17. An apparatus according to claim 14, wherein the sensor is sensitized in view of a shape of the marking.

18. An apparatus according to claim 14, wherein said controller includes a storage wherein a sensor setting value determined during the sensitization of the sensor is stored in the controller.

19. An apparatus for tractor-less transport of a recording medium in a printer device, the recording medium having markings for pages, comprising:

a controller that drives the transport motor such that the recording medium is transported a prescribed length along a conveying direction with a first relatively slow speed;

an evaluator;

a sensor that senses a predetermined region of the recording medium during transport and sends sensing signals to said evaluator;

said evaluator being operable to investigate whether the sensing signals agree with an identifier of the marking and identify transport length lying between two successive identical ones of the markings as a value for a page length; and said controller initiating printing with a second relatively high transport speed and controlling transport with the identified value for the page length.

20. A printer having an apparatus for controlling a tractor-less recording medium drive in an electrographic printer that outputs information on a recording medium that is web shaped, the recording medium having an identical optical marking on pages, comprising:

a transport motor;

controller that drives the transport motor such that the recording medium is transported a prescribed length along a conveying direction with a first relatively slow speed;

an evaluator;

a sensor that senses a predetermined region of the recording medium during transport and sends sensing signals to said evaluator;

said evaluator being operable to investigate whether the sensing signals agree with an identifier of the marking and identify transport length lying between two successive identical markings as a value for a page length; and said controller initiating printing with a second relatively high transport speed and controlling transport with the identified value for the page length.

21. A method for controlling a tractor-less recording medium drive for a web-shaped recording medium in an electrographic printer, the web-shaped recording medium having an identical optical marking on pages, comprising the step of:

transporting the recording medium first with a first speed, acquiring a transport length of the recording medium lying between two successive identical markings and identifying the transport length as a value for a page length with an evaluator and a sensor; and for printing, transporting the recording medium with a transport speed that is higher compared to the first speed and controlling the transporting of the recording medium utilizing the identified value for the page length.

* * * * *